United States Patent [19]

Hahne

[11] Patent Number: 4,641,993

[45] Date of Patent: Feb. 10, 1987

[54] HIGHWAY BARRIER WITH LEVEL INTERNAL DUCTS AND CONSTRUCTION METHOD

[75] Inventor: Walter B. Hahne, Corona Del Mar, Calif.

[73] Assignee: Associated Concrete Products, Santa Ana, Calif.

[21] Appl. No.: 787,083

[22] Filed: Oct. 15, 1985

Related U.S. Application Data

[63] Continuation-in-part of Ser. No. 607,429, May 7, 1984, abandoned.

[51] Int. Cl.[4] ..... E01C 11/22; E01F 13/00

[52] U.S. Cl. ..... 404/4; 404/6; 249/145

[58] Field of Search ..... 404/2, 3, 4, 6, 7, 13, 404/12; 256/1, 13, 13.1; 249/144, 145, 175, 184, 186; 405/43–45

[56] References Cited

U.S. PATENT DOCUMENTS 1,598,059 8/1926 Cykler ..... 249/145

4,105,353 8/1978 Bork et al. ..... 404/2

*Primary Examiner*—James A. Leppink

*Assistant Examiner*—John F. Letchford

*Attorney, Agent, or Firm*—Grant L. Hubbard

[57] ABSTRACT

A roadway barrier section includes a duct formed of two intersecting frusto-conical portions placed end-to-end so that the central portion thereof. The duct is formed using two tapering mold plugs that are preferably frusto-conical. The mold plugs are placed in a concrete form so that the lower edge of the duct is a straight line that is generally parallel to the base of the barrier section.

3 Claims, 6 Drawing Figures

Fig. 1
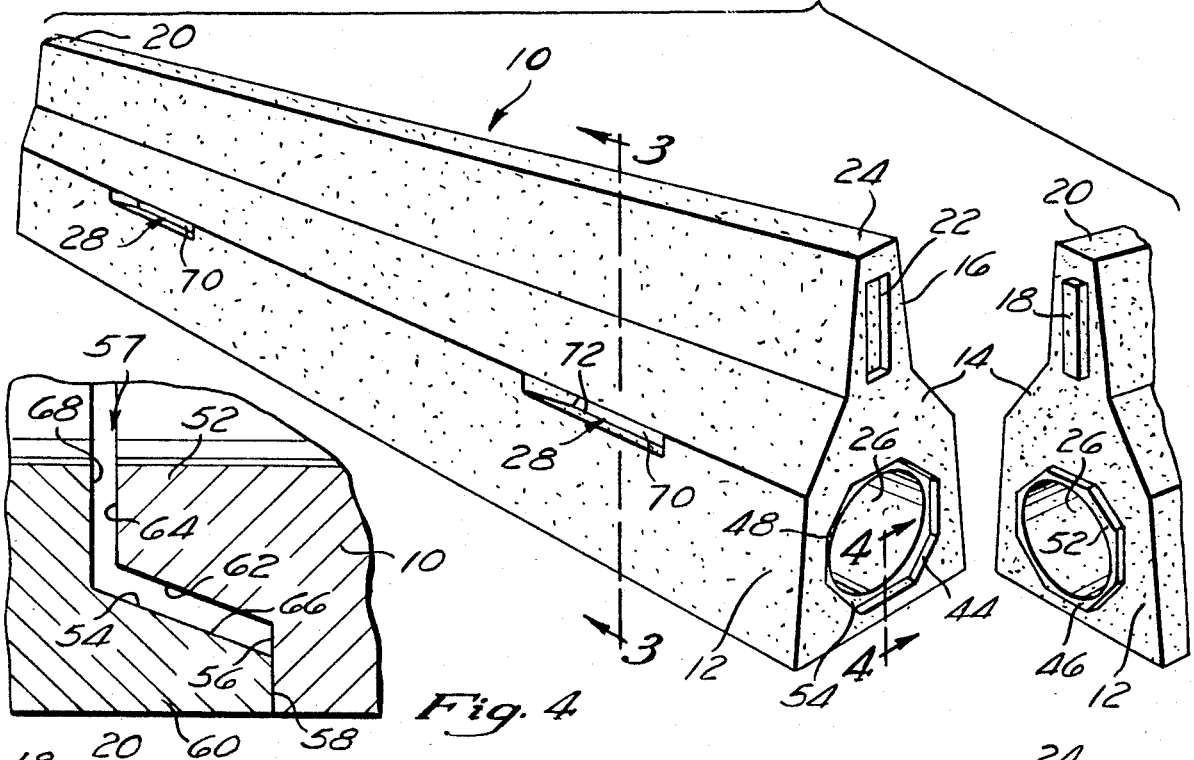
Fig. 4
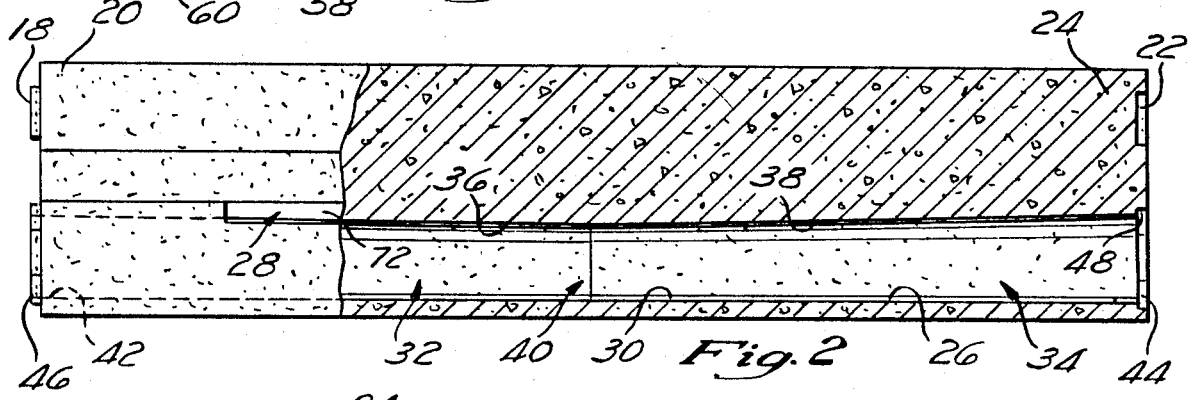
Fig. 2
Fig. 3
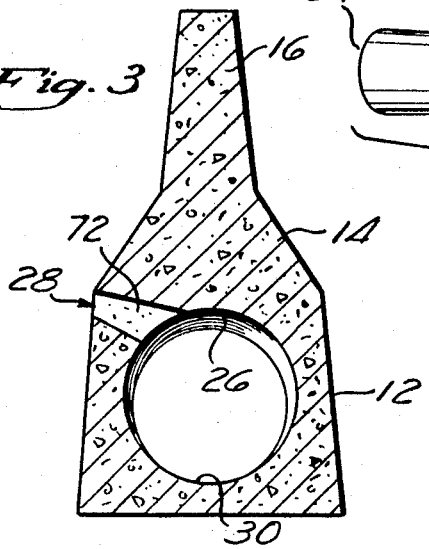
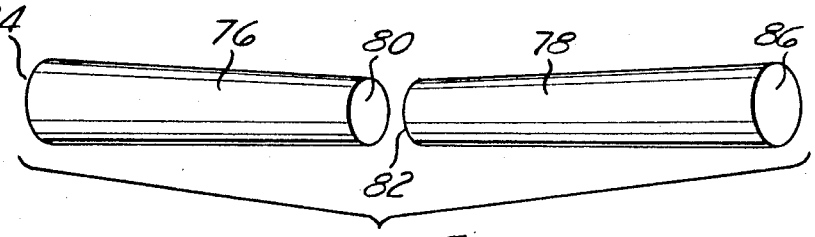
Fig. 5
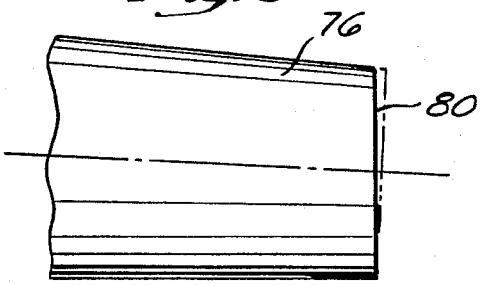
Fig. 6

HIGHWAY BARRIER WITH LEVEL INTERNAL DUCTS AND CONSTRUCTION METHOD

CROSS-REFERENCE TO RELATED APPLICATION

This is a continuation-in-part of Ser. No. 607,429, filed May 7, 1984 now abandoned, "IMPROVED BARRIER WITH INTERNAL DUCTS" now pending.

BACKGROUND OF THE INVENTION

This invention relates generally to barriers or dividers suitable for blocking or dividing roadways and particularly to a barrier section having internal ducts and passageways for providing drainage and a conduit for cables, such as electrical or telephone cables, and method of construction of such a barrier.

It has become conventional practice to employ a barrier for separation oppositely directed traffic lanes. Such barriers may be either permanently emplaced in the center divider between lanes or temporarily emplaced to direct traffic away from particular locations, such as construction sites in or adjacent roadways. The barriers are formed to prevent automobiles from crossing into the path of oppositely directed traffic and therefore prevent "head-on" collisions. Typically such barriers comprise a plurality reinforced concrete sections placed end-to-end to extend a desired length, which may vary from several feet to many miles. Some barrier sections include coupling means for securing adjacent ends together to form a continuous rigid structure.

Such barriers typically include a base portion that has a generally rectangular or trapezoidal cross section, a tapered intermediate portion and an upstanding portion that may also be tapered. The base ordinarily rests upon or is embedded in the center divider between lanes. The lowermost edge of the base is generally the widest portion of the barrier. The intermediate portion tapers from the width of the uppermost edge of the base to the width of the lowermost edge of the upstanding portion.

Although these conventional barriers have been successful in preventing vehicle crossover from on lane to another, difficulties have been encountered which stem largely from the fact that low spots in the roadway collect water, debris and other foreign matter and such collection provides an undesired hazard to the driver of the vehicle. Conventional practice provides for external drainage systems such as open channels, grooved surfaces and the like for conducting water from the roadway surface. Such practices have not been particularly successful due to the fact that puddles and exposed water does still exist since drainage takes time. Also, conventional barriers are not equipped to carry electrical cabling, pipes or other ancillary equipment.

U.S. Pat. No. 4,105,353 issued Aug. 8, 1978, to Bork, et al. discloses a barrier having a longitudinal internal drainage duct extending the length thereof through the base and a smaller diameter passageway through to the intermediate portion. The duct is suitable for use in a drainage system for carrying water. Both the duct and the passageway are suitable for carrying telephone and electrical wires or the like. When used in a drainage system, the ducts have side openings extending therefrom to the outer surface of the barrier so that water may flow into the ducts. The barrier has a male end and a female end so that a line of interconnected barriers may be formed.

The barrier disclosed in U.S. Pat. No. 4,105,353 functions satisfactorily to prevent vehicle crossovers into oppositely directed lanes and to provide conduits for drainage or cables. However, there are significant difficulties encountered in the fabrication of such barrier sections. The ducts are cylindrical, which means that a cylindrical mold must be included in the forms used for molding and curing the concrete of which the barriers are formed. After the concrete has been poured and cured sufficiently to maintain its shape while unsupported, the cylindrical mold must be withdrawn from the concrete, leaving a cylindrical passage or duct therethrough. Even though oil or other suitable substances may be coated onto the outer surface of the cylindrical mold before pouring the concrete, friction between the mold and the surrounding concrete may cause great difficulty in removing the mold. Removing the mold from the concrete is therefore time consuming and expensive, leading to a loss of productivity of workers and equipment. An alternative to removing the mold is to include a pipe of the desired length and diameter in the barrier section. Since modern roadway construction requires a great number of barrier sections, which should be manufactured as economically as possible, including pipes in the barriers is not generally regarded as an economically viable alternative to removing the molds from the barriers.

It is known to manufacture concrete piles with tapered passages; U.S. Pat. No. 1,598,059, but horizontal flow is not there contemplated.

Therefore, there is a need in the art for an improved roadway barrier and method of construction to provide lengthwise ducts with molds that are conveniently and easily removed from the barrier after the concrete has cured sufficiently to permit removal of the molds and which permit horizontal flow.

SUMMARY OF THE INVENTION

This invention overcomes the difficulties associated with fabrication of roadway barriers having ducts or conduits therein. The method of the invention uses a pair of tapered mold plugs which each are about half the length of the barrier section. The mold plugs butt together where the central portion of the duct is to be formed. Significant frictional forces are encountered only upon initial movement in withdrawal of the mold plugs from the barrier sections and a passage which is flat on the bottom side is obtained.

The mold plugs are preferably frusto-conical, formed to provide a flat and level bottom in the ducts with only the upper portions of the duct having a taper that narrows from the end of the barrier toward the center. In order to form a level bottom in the duct using frusto-conical mold plugs, the narrower ends of the mold plugs must be formed so that they join to provide a continuous mold so that no concrete enters into the region where the duct should exist.

The invention provides a barrier that is more economically constructed than previous barriers while accomplishing the same functions as previous barriers, namely safely and effectively dividing traffic lanes while providing ducts for drainage or for carrying cables.

BRIEF DESCRIPTION OF THE DRAWINGS

FIG. 1 is a perspective view of a precast concrete median barrier according to the invention;

FIG. 2 is a partial cross sectional view of the barrier of FIG. 1 showing a duct and a drainage scupper;

FIG. 3 is a cross sectional view about line 3—3 of FIG. 1;

FIG. 4 is a cross sectional view about line 4—4 of FIG. 1 shown details of a barrier joint;

FIG. 5 is a perspective view of mold plugs used to form a drain conduit in the barrier of FIG. 1; and FIG. 6 is a perspective view showing details of an inner end of one of the mold plugs of FIG. 5.

DESCRIPTION OF THE PREFERRED EMBODIMENT

Referring to FIG. 1, a barrier section 10 includes a base 12, an intermediate foot section 14 and an upstanding section 16. The base 12, intermediate foot section 14 and the upstanding section 16 are preferably integrally formed and are referenced as separate sections only for ease of description. The barrier section 10 further includes a projection 18 at an end 20 and a corresponding recess 22 at the opposite end 24, a duct 26 and a plurality of drainage scuppers 28.

Referring to FIG. 2, the duct 26 preferably has a bottom surface 30 that is preferably parallel to the longitudinal axis of the base 12 so that the base 12 and the bottom 30 of the duct 26 make the same angle with the horizontal. The duct 26 is shown to be comprised of a pair of sections 32 and 34 that are mirror images of one another.

The upper sections 32 and 34 have upper edges 36 and 38 that taper toward the bottom 30 of the duct 26 so that the duct 26 is narrower at central portion 40 where the sections 32 and 34 meet than at the ends 20 and 24. The section 32 has an opening 42 at the end 20 of the barrier 10. The opening 42 has a greater cross sectional area than the end of the section 32 at the central portion 40 of the duct 26. Similarly, the portion 34 has an opening 44 at the end 24. The openings 42 and 44 have substantially the same dimensions with the primary difference between the openings 42 and 44 being a projection 46 extending from the end 20 around the opening 20 and a recess 48 extending into the end 24. The projection 46 fits into a recess similar to the recess 48 when the barrier section 10 is connected to an end similar to the end 24 of another barrier (not shown).

Referring to FIGS. 1 and 4, the openings 42, 44 may include a male key 52 and a female key 54, respectively. The male key 52 and female key 54 may be of any suitable configuration to interconnect a pair of barriers such as the barrier 10 end-to-end. As shown in FIG. 1, the male key 52 and the female key 54 have octagonal cross sections with the male key 52 having sides slightly smaller than those of the female key 54. The dimensions of the sides of the male key 52 and the female key 54 are such that the male key 52 easily penetrates into the female key as shown in FIG. 4. An end 56 of the male key 52 abuts an end 58 of a second barrier section 60 when the barrier sections 10 and 60 are properly connected to form a joint 57. The male key 52 has a pair of surfaces 62 and 64 that are parallel with and slightly spaced apart from a pair of corresponding surfaces 66 and 68 on the female key 54 when the surfaces 56 and 58 abut one another. A suitable sealant (not shown) may be placed between the surfaces 62, 64 and the surfaces 66, 68 to prevent moisture from flowing into or out of the joint 57 between barrier sections 10 and 60.

FIGS. 1, 2 and 3 illustrate details of the drainage scupper 28. As shown in FIGS. 1 and 2, the drainage scupper 28 includes a generally rectangular opening 70 that leads into a duct 72, as best shown in FIG. 3. The duct 72 intersects the duct 26 so that watermay flow through the opening 70 and the duct 72 into the duct 26. Although the barrier 10 is shown to have two drainage scuppers 28, any desired number of similar drainage scuppers could be included.

The preferred method of forming the barrier section 10 is to mount a pair of tapered mold plugs 76 and 78 in a conventional concrete form. The mold plugs 76 and 78 may be frusto-conical as shown in FIG. 5, but may have trapezoidal cross sections having lower edges which form the desired flat bottom portion in the duct 26. The preferred embodiment thus provides a method for forming barrier sections that may be placed end-to-end to include a straight, horizontal duct with no low spots in water which could collect and stagnate.

If the mold plugs 76 and 78 are frusto-conical, then they must have surfaces 80 and 82, respectively formed on the smaller ends thereof which butt together to form a continuous mold. The taper of the mold plugs is ordinarily only about 203 inches of diameter for 10 feet of length. Therefore, the duct 26 has only a small deviation from the cylindrical ducts (not shown) included in previous barriers.

In order to form smooth inner surfaces in the duct 26, the ends 80 and 82 must be formed to match closely with one another. As best shown in FIG. 6, the end 80 of the mold plug 76 is generally planar, making a small acute angle with respect to the vertical. The mold plugs 76 and 78 each have a second end 84 and 86, respectively, which may be perpendicular to the longitudinal axis thereof. The end 82 of the mold plug 78, therefore, must be formed to abut the end 80 of the mold plug 76 so that there are no gaps therebetween.

The mold plugs 76 and 78, being tapered, are easy to pull out of the concrete barrier section 10. Appreciable resistance is encountered only during initial movement of the mold plugs, unlike cylindrical mold plugs, which experience substantial frictional resistance to their withdrawal along the entire length thereof.

What is claimed is:

1. A method for forming a roadway barrier section having a duct therein comprising the steps of:

placing a first frusto-conically shaped mold plug in a concrete form;

placing a second frusto-conically shaped mold plug in the concrete form;

positioning the first and second mold plugs end to end with the smaller end of each plug abutting each other;

aligning one frusto-conical side of the first plug with one frusto-conical side of the second plug to form a continuous mold for the duct, said aligned sides defining a substantially straight line the entire length of the duct, for forming a duct which has one side, which when the barrier is in use is disposed as the bottom of the duct, defining a substantially straight line, the top side of the duct defining a center portion which is smaller than the end portions of the duct;

pouring concrete into said form;

allowing the concrete to cure; and removing the first and second mold plugs from the concrete.

2. The method of claim 1 further including the steps of:

forming a projection in a first end of the barrier section; and forming a recess in the other end of the barrier section to correspond to the projection so that a plurality of such barrier sections may be joined end-to-end to form a continuous barrier.

3. The method of claim 1 further including the step of forming drainage scuppers in sides of the barrier section to permit fluid communication between the sides of the barrier section and the duct.

* * * * *